US011117715B2

(12) United States Patent
Brozell et al.

(10) Patent No.: US 11,117,715 B2
(45) **Date of Patent: *Sep. 14, 2021**

(54) VACUUM RELEASE SEAL FOR A CLOSURE AND CONTAINER PACKAGE

(71) Applicant: Owens-Brockway Glass Container Inc., Perrysburg, OH (US)

(72) Inventors: Brian J. Brozell, Maumee, OH (US); Brian J. Chisholm, Sylvania, OH (US); Edward A. Grant, Toledo, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/425,001

(22) Filed: May 29, 2019

(65) Prior Publication Data

US 2019/0276191 A1 Sep. 12, 2019

Related U.S. Application Data

(62) Division of application No. 14/856,022, filed on Sep. 16, 2015, now Pat. No. 10,351,309.

(51) Int. Cl.

| | |
|---|---|
| ***B65D 43/02*** | (2006.01) |
| ***B65D 53/02*** | (2006.01) |
| ***B65D 51/16*** | (2006.01) |

(52) U.S. Cl.

CPC ..... *B65D 43/0231* (2013.01); *B65D 51/1688* (2013.01); *B65D 53/02* (2013.01)

(58) Field of Classification Search

CPC ..... B65D 1/1622; B65D 1/1633; B65D 51/1683; B65D 51/1688; B65D 51/1661; B65D 43/0231; B65D 53/02

See application file for complete search history.

(56) References Cited

U.S. PATENT DOCUMENTS

| | | | | |
|---|---|---|---|---|
| 2,244,316 A | | 6/1941 | Robertson | |
| 2,886,198 A | | 5/1959 | Herter | |
| 3,052,478 A | | 9/1962 | Horvereid | |
| 3,227,302 A | | 1/1966 | Merrill | |
| 3,924,772 A | | 12/1975 | Magnani | |
| 4,093,094 A | * | 6/1978 | Smalley | B65D 51/145 215/276 |
| 4,190,259 A | | 2/1980 | Zitting | |
| 4,572,390 A | | 2/1986 | Grittmann | |
| 4,629,084 A | * | 12/1986 | Hackelsberger | B65D 45/18 206/508 |
| 4,740,401 A | | 4/1988 | Barkhan et al. | |

(Continued)

FOREIGN PATENT DOCUMENTS

WO 2008030640 A1 3/2008

OTHER PUBLICATIONS

U.S. Office Action, U.S. Appl. No. 14/691,662, filed Apr. 21, 2015, dated Jul. 27, 2018.

(Continued)

*Primary Examiner* — Andrew T Kirsch

(57) ABSTRACT

A glass container includes a base, a body extending axially from the base, and a neck finish extending from the body, the neck finish having an axial sealing surface, wherein at least a portion of the axial sealing surface extends both axially downwardly and radially outwardly. Also disclosed is a package including a glass container and a closure assembly.

19 Claims, 9 Drawing Sheets

(56) References Cited

U.S. PATENT DOCUMENTS

| | | | | |
|---|---|---|---|---|
| 5,062,538 | A * | 11/1991 | Ochs | B65D 41/04 215/252 |
| 5,984,124 | A | 11/1999 | Takano | |
| 6,276,543 | B1 | 8/2001 | German et al. | |
| 6,662,958 | B2 | 12/2003 | German et al. | |
| 7,004,341 | B2 | 2/2006 | Shenkar et al. | |
| 7,861,874 | B2 | 1/2011 | Cook et al. | |
| 9,315,306 | B2 * | 4/2016 | Taber | B65D 51/145 |
| 10,351,309 | B2 * | 7/2019 | Brozell | B65D 51/1688 |
| 2007/0262041 | A1 | 11/2007 | Smith | |
| 2012/0037587 | A1 | 2/2012 | Tirosh | |
| 2014/0263321 | A1 | 9/2014 | Chishom | |

OTHER PUBLICATIONS

Int. Search Report and Written Opinion, Int. Application No. PCT/US2016/047284, Int. Filing Date: Aug. 17, 2016, Applicant: Owens-Brockway Glass Container Inc., dated Nov. 29, 2016.

Int. Search Report and Written Opinion, Int. Application No. PCT/US2014/020970, Int. Filing Date: Mar. 6, 2014, Applicant: Owens-Brockway Glass Container Inc., dated May 28, 2014.

Extended European Search Report, Application No. 20191569.1-1017, Applicant: Owens-Brockway Glass Container Inc., dated Dec. 10, 2020.

* cited by examiner

VACUUM RELEASE SEAL FOR A CLOSURE AND CONTAINER PACKAGE

BACKGROUND AND SUMMARY OF THE DISCLOSURE

Containers often include a body and a neck finish extending axially from the body to accept a closure. The body usually includes a base, a sidewall extending axially away from the base, and a shoulder between the sidewall and the neck finish. The neck finish typically includes circumferentially extending threads to cooperate with corresponding features of the closure, and a circular end surface to cooperate with a seal on an undersurface of the closure. U.S. Pat. No. 2,244,316 illustrates a glass container and closure of this type.

A general object of the present disclosure is to provide a seal that cooperates with a closure to release the vacuum in the package when the closure is loosened.

The present disclosure embodies a number of aspects that can be implemented separately from or in combination with each other.

In accordance with one aspect of the present disclosure, there is provided a glass container, comprising a base, a body extending axially from the base, and a neck finish extending from the body, the neck finish having an axial sealing surface, wherein at least a portion of the axial sealing surface extends both axially downwardly and radially outwardly.

In accordance with another aspect of the present disclosure, there is provided a package, comprising a container having a neck finish extending to an axial sealing surface that defines a container mouth, the neck finish having a plurality of retention features, and a closure assembly. The closure assembly includes a skirt including a cylindrical wall having an upper portion that includes a radially, inwardly extending flange and a lower portion that includes a seal retaining bead and a plurality of cams extending radially inwardly from an inner surface of the wall. The closure assembly also includes a base, and a seal for a closure assembly, including a seal ring, and a carrier being coupled to the seal ring, extending circumferentially and radially outwardly of the seal ring to a radially outer periphery, and having a circumferentially extending pocket in the radially outer periphery adapted to release a vacuum pressure. The seal further comprises a plurality of closure-driven features located radially inwardly of and spaced circumferentially along the radially outer periphery, at least one of the plurality of closure-driven features includes the pocket and the spring portion. The base and the seal are captively carried between the flange and the seal retaining bead, wherein the circumferential location of the cams corresponds to the plurality of closure-driven features, wherein the cams protrude into the plurality of closure-driven features. The seal further comprises a cam follower carried by one of the plurality of closure-driven features. The seal ring of the seal is compressed between the base and the axial sealing surface of the container when the container retention features are engaged with a plurality of corresponding retention features on the closure assembly. When the skirt is rotated with respect to the container, then at least one of the plurality of cams compresses the spring portion and another cam engages the cam-follower deforming a local region of the seal radially inwardly to release the vacuum pressure.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
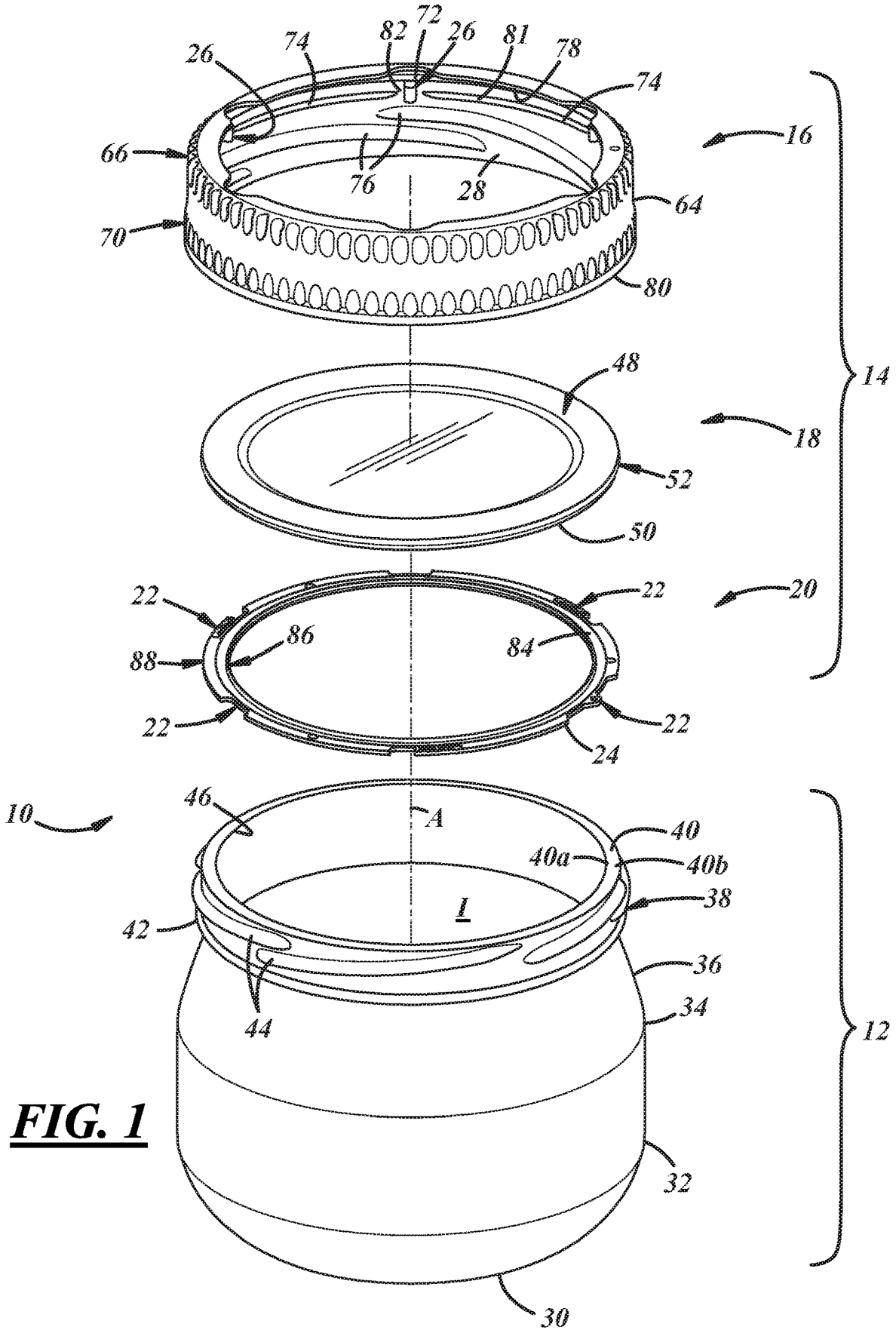
FIG. 1 is an exploded perspective view of a container package in accordance with an illustrative embodiment of the present disclosure that includes a container, a closure assembly that includes a skirt and a base, and a first embodiment of a seal.

FIG. 1 illustrates an exploded perspective view of a container package 10 along a longitudinal axis A in accordance with an illustrative embodiment of the present disclosure that includes a container 12 and a closure assembly 14 that includes a skirt 16, a base or lid 18, and a seal 20 for sealing the contents or product of the container 12 under a vacuum pressure. More specifically, the seal 20 may be received between the base 18 and the container 12 while the skirt 16 compresses the seal 20. The seal 20 may have multiple closure-driven features 22 circumferentially spaced at a radially outer periphery 24 of the seal 20. When the skirt 16 is rotated, at least some of these features 22 may engage one or more cams 26 on the skirt 16 to facilitate the release of a vacuum or vacuum pressure within the container 12.

Figure 3:
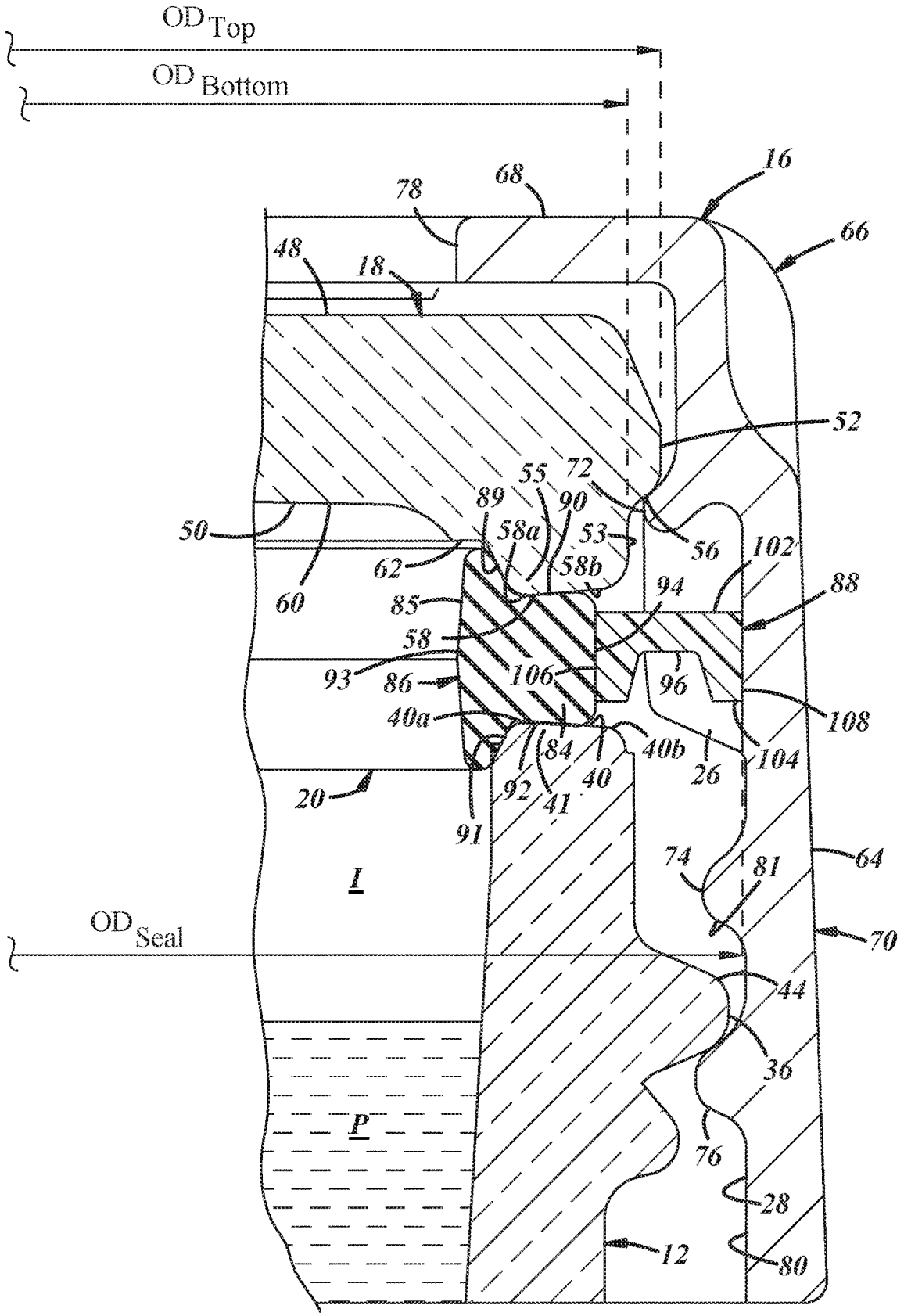
FIG. 3 is a fragmentary sectional view of the container package of FIG. 1, the seal being in the first position.
Figure 7:
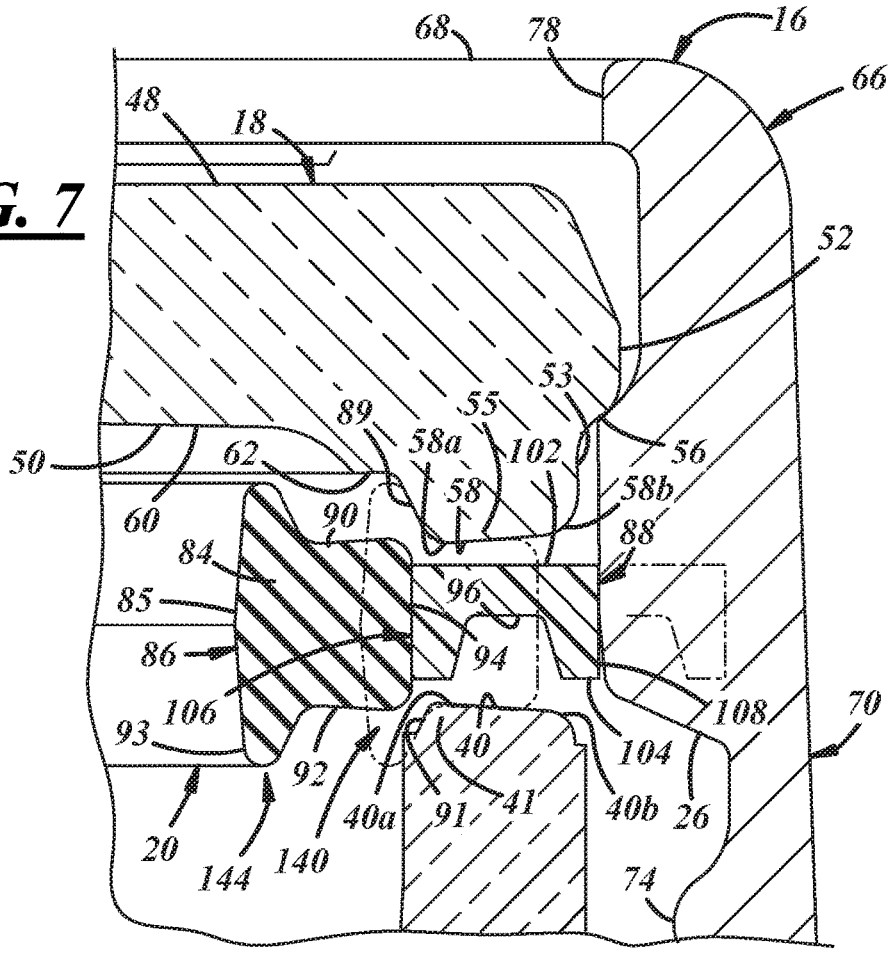
FIG. 7 is a fragmentary sectional view of the container package of FIG. 1 illustrating movement of the seal from the first position to the second position.
Figure 8:
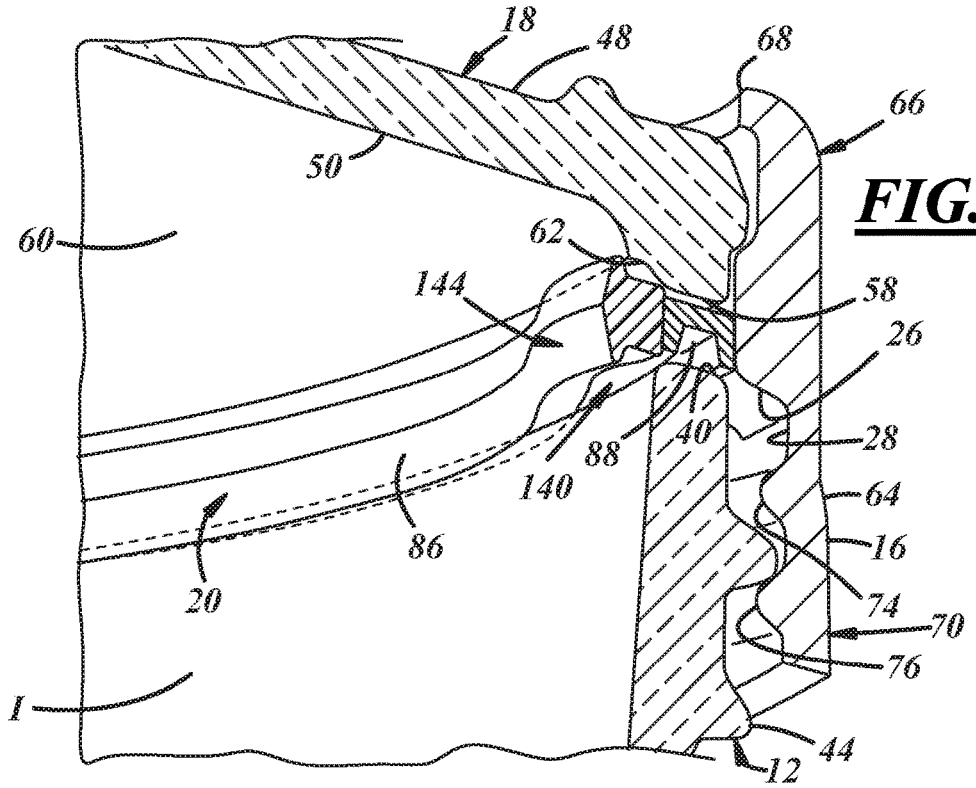
FIG. 8 is a fragmentary sectional view, shown in perspective, of the container package of FIG. 1, the seal being in the second position.
Figure 9:
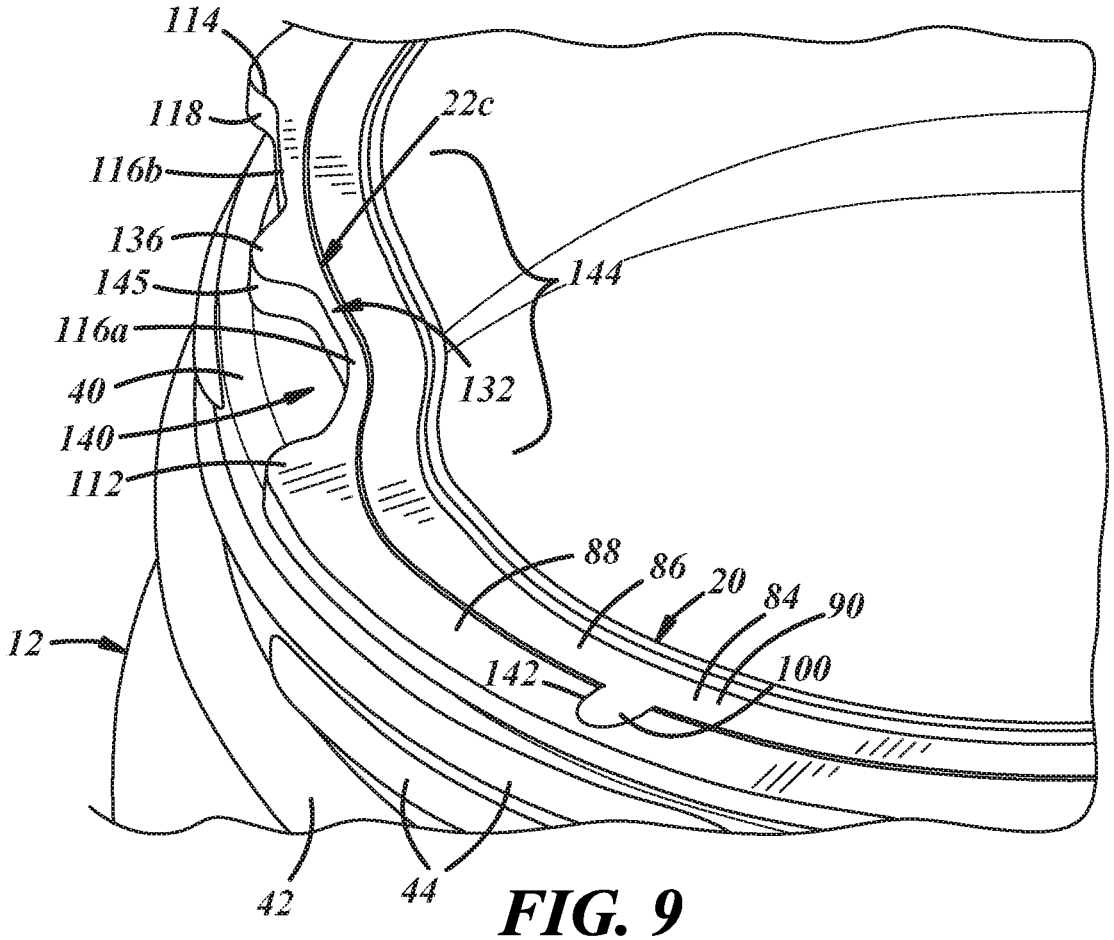
FIG. 9 is a fragmentary perspective view of the container package of FIG. 1 with the closure assembly removed for clarity, the seal being in the second position.

The container 12 of FIG. 1 may include a base 30 and a body 32 axially or upwardly extending from the base 30 to a shoulder 34. The shoulder 34 may continue extending axially to a neck 36 having a neck finish 38 extending to an axially facing sealing surface 40. The neck finish 38 includes multiple securement or retention elements 44 that collectively may extend around the entire circumference of the neck finish 38; in some embodiments, the neck finish 38 further includes a transfer bead or capping flange 42. The retention elements 44 may include lugs, bayonets, thread segments, or any other suitable features. As used herein, the phrase "thread segment" includes whole, partial, multiple, and/or an interrupted thread and/or thread segment. The container 12 may have a mouth 46 at the sealing surface 40 opening to a container interior or interior space (I) for carrying contents or product (P) [FIG. 3]. The sealing surface 40 may be sized for engagement with corresponding portion(s) of the closure assembly 14. In some implementations, the sealing surface 40 is generally parallel with respect to the base 30. However, in at least one implementation (as shown in FIGS. 3 and 7), it may have a circumferential bevel or wedge 41—extending more axially away from the base 30 at a radially inwardly portion 40*a* of the sealing surface 40 than at a radially outwardly portion 40*b*. As will be explained in greater detail below, the circumferential bevel 41 may act to better retain the seal 20 between the container 12 and base 18 (and more particularly, to inhibit the seal 20 from being drawn into the container 12 by a vacuum therein).

The container 12 may be comprised of glass or any other material suitable for containing food products (e.g., cold and/or hot-fill food products). In one example, the container 12 may be suitable for hot-fill applications of product at 185° F. and above, and can be developed for retort applications at temperatures of 260° F. and above. Retort applications include any category of food packaging using sealable laminates (e.g., flexible plastics, metal foils, etc.). In other implementations, the container 12 may carry non-food products including liquids, gels, powders, particles, and the like. And in at least some implementations, the container 12 may be manufactured in accordance with a glass manufacturing process as will be described below.

The closure assembly 14 may have multiple parts or components (e.g., the base 18 and the seal 20 may be detachable or removable from the skirt 16). In one embodiment shown in FIG. 3, the base 18 may be generally disc-like or plate-like. The base 18 may include a top side 48 extending to an upper radially peripheral edge 52 and an undersurface or bottom 50 extending to a lower radially peripheral edge 53, recessed radially with respect to the edge 52 via a circumferential lip 56. An outer diameter ($OD_{TOP}$) of the peripheral edge 52 is greater than an outer diameter ($OD_{BOTTOM}$) of the recessed edge 53, wherein the lip 56 of the base 18 may be carried by the skirt 16. On the bottom 50, a circumferential sealing surface 58 may extend radially inwardly with respect to the edge 53, and radially outwardly of a central region or roof portion 60 of the base 18. The sealing surface 58 may be parallel to the top side 48 of the base 18. However, in at least one implementation (as shown in FIGS. 3 and 7), it may have a circumferential bevel or wedge 55—extending more axially away from the top side 48 at a radially inwardly portion 58*a* of the sealing surface 58 than at a radially outwardly portion 58*b*. As will be explained in greater detail below, the circumferential bevel 55 (on the base 18) may act to better retain the seal 20 between it and the circumferential bevel 41 (on the container 12). In one embodiment, a secondary lip 62 is radially inboard of the sealing surface 58 and sized to accommodate a portion of the seal 20, as will be described more below. The base 18 may be include glass; however, plastic, metal, or other suitable materials are also possible.

Figure 5:
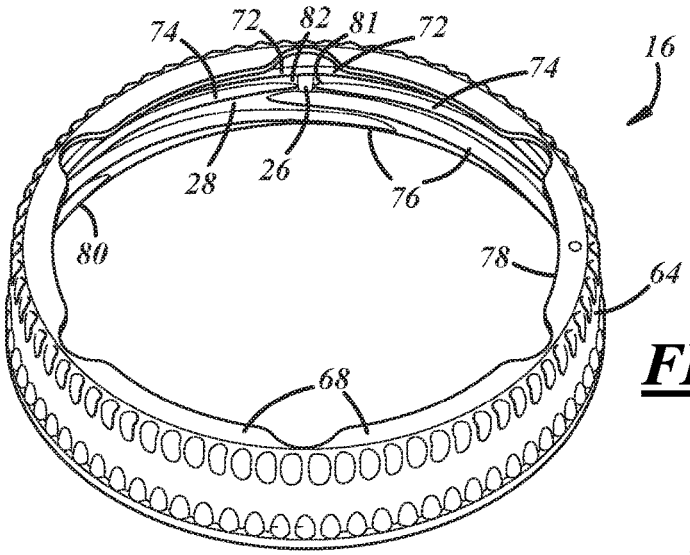
FIG. 5 is a perspective view of the skirt of the closure assembly.

As shown in FIGS. 3 and 5, the skirt 16 includes a cylindrical wall 64 having an upper portion 66 that includes a radially, inwardly extending flange 68 and a lower portion 70 that includes a number of features extending radially inwardly from an inner surface 28 of the wall 64, including a base retaining bead or base retainer 72, a seal retaining bead or seal retainer 74, one or more cams 26, and one or more securement or retention elements 76. Thus, as shown, the skirt 16 may have two openings—a top opening 78 defined by the flange 68 and a bottom opening 80 defined by the inner surface 28 at the lower portion 70 of the wall 64 that is sized to receive the base 18, the seal 20, and the container 12.

The base retaining bead 72 on the skirt 16 may include any protrusion extending radially, inwardly and at least partially circumferentially along the inner surface 28 adapted to capture and retain the base 18. For example, the bead 72 may be a continuous protrusion, as illustrated, or in some embodiments, it may be segmented. Thus, an inner diameter of the bead 72 may be less than or equal to the top side diameter (ODrop) of the base 18 providing for a press-fit or press-through engagement of the bead 72 and the peripheral edge 52 of the base 18. And after the base 18 is located between the flange 68 and base retaining bead 72, the bead 72 may carry the base at the base's circumferential lip 56.

The seal retaining bead 74 may be adapted to carry and/or capture the seal 20 and may be any continuous or segmented circumferential protrusion extending radially inwardly along the inner surface 28 of the skirt 16 located between the base retaining bead 72 and the bottom opening 80. As best shown in FIGS. 1 and 5, the seal retaining bead 74 may be segmented—each segment 81 being spaced circumferentially from one another by a gap 82. One cam 26 may be located at each gap 82 (e.g., alternating segments 81 and cams 26).

The cam(s) 26 include any ridge, projection, or the like extending radially inwardly from the inner surface 28 of the skirt 16 and adapted to cooperate with the closure-driven features 22 on the seal 20 when then the closure assembly 14 is actuated, as will be described below. In the illustrated embodiment, the cams 26 axially extend both toward the base retaining bead 72 and the bottom opening 80; however, this is merely an example. In at least one implementation, the skirt 16 has six evenly circumferentially spaced gaps 82 and six evenly circumferentially spaced cams 26.

The retention element(s) 76 on the skirt 16 may be configured to secure the closure assembly 14 to the retention elements 44 of the container 12. The retention elements 76 may be located between the seal retaining bead 74 and the bottom opening 80 and may protrude radially inwardly having an axial component as well (e.g., similar to retention elements 44). Collectively, the retention elements 76 may extend circumferentially around the entirety of the inner surface 28 of the skirt 16. Non-limiting examples of the retention elements 76 include lugs, bayonets, thread segments (e.g., whole, partial, multiple, and/or an interrupted thread), and any other suitable features. Further, the skirt 16 may be comprised of any suitable material such as metal or plastic, and in at least one embodiment, the skirt 16—including the base retaining bead 72, seal retaining bead 74, cams 26, and retention elements 76—may be formed in a single piece of material, e.g., having a unitary construction.

Figure 4B:
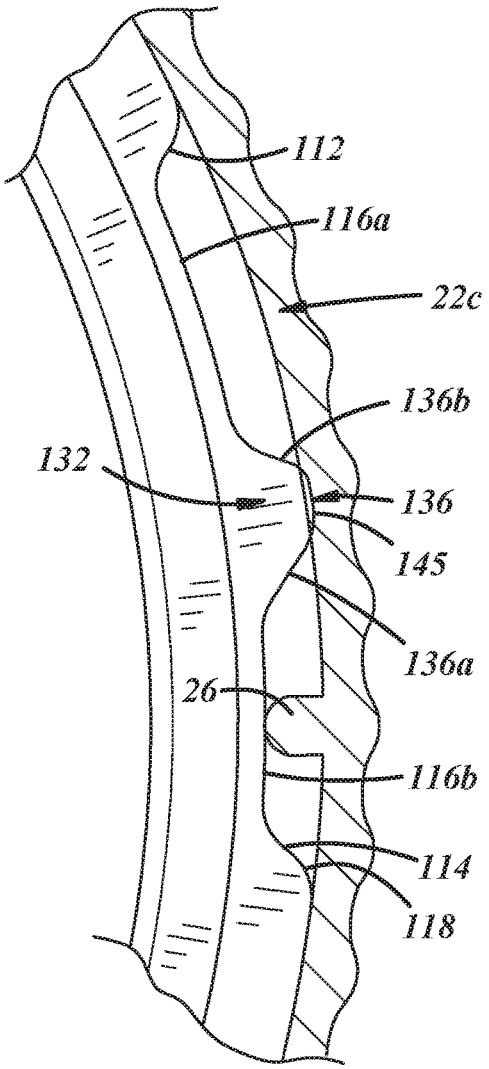
FIG. 4B is an enlarged view of another embodiment of a closure-driven feature shown in FIG. 2.
Figure 4A:
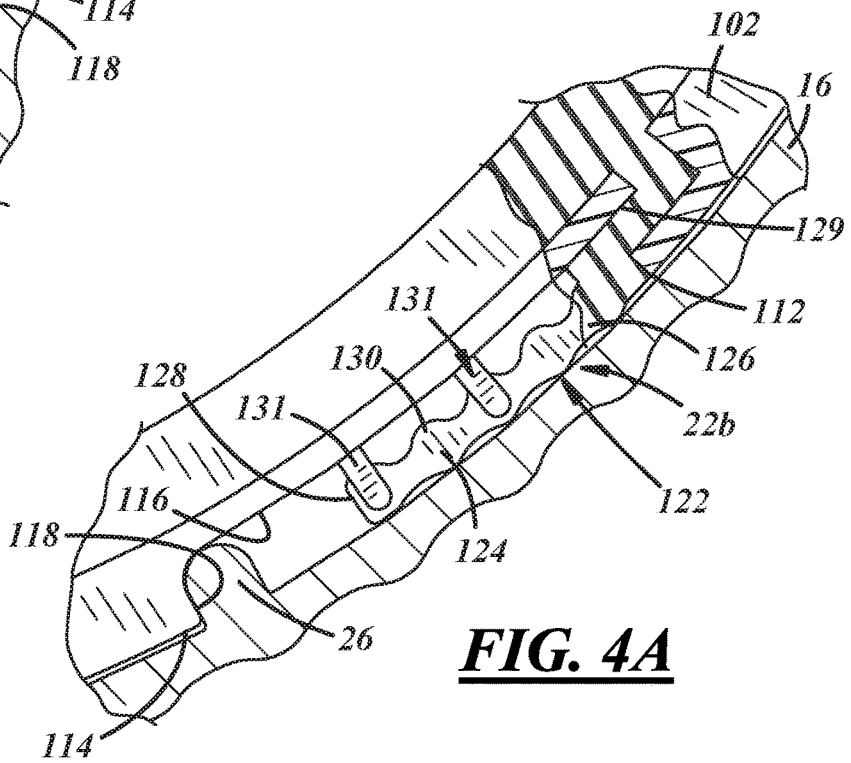
FIG. 4A is an enlarged view of one embodiment of a closure-driven feature shown in FIG. 2.

With reference to FIGS. 3, 4A, and 4B, the seal 20 may be adapted to isolate the contents P within the interior I from the air outside of the container 12 and includes a sealing portion or seal ring 86 coupled to a circumferentially extending, radially outboard carrier 88. The seal 20, as shown in section in FIG. 3, may comprise multiple materials; e.g., the seal ring 86 being of a first, more flexible material and the carrier 88 being of a second, more rigid material. Non-limiting examples of the first material include a silicon material, a plastic material, a rubber material, any combination of silicon material(s), plastic material(s), or rubber material(s) (e.g., including any suitable thermoplastic elastomer (TPE)), and non-limiting examples of the second material include thermoplastic polymers such as polypropylene. Thus, the material of the seal ring 86 suitably may compress and deform to enable adjoining the container 12 and base 18, and the rigidity of the material of the carrier 88 resiliently may return the seal 20 to its annular form following deformation(s).

A cross-sectional shape of the seal ring 86 (FIG. 3) may have a body 84 sized to be pinched between the sealing surfaces 40, 58 (of the container 12 and base 18, respectively) that may be T-shaped, having a head 85 extending radially inwardly from the body 84 and formed to hug or adjoin inner regions 89, 91 of the base 18 and the container 12, respectively. In FIG. 3, an upper side 90 of the body 84 engages the sealing surface 58 of the lid 18, a lower side 92 engages the sealing surface 40 of the container 12, and a radially inwardly facing surface 93 defines part of the head 85. It should be appreciated that the illustrated shape is merely an example; e.g., seal ring 86 may have any other suitable cross-sectional shapes such as a circle, an oval, a rectangle, a heart or cardioid-shape, etc. A radially outwardly facing surface 94 of the seal ring 86 may be coupled to the carrier 88 (e.g., overmolded within or by carrier 88). In addition, as shown in FIG. 2, one or more circumferentially spaced tabs or nubs 100 may extend radially outwardly of the surface 94 to provide additional binding to the carrier 88 (e.g., by providing additional surface area for adherence, e.g., when the carrier 88 is overmolded to the seal ring 86).

The carrier 88 may be any generally annular-shaped member that includes closure-driven features 22 which contribute to releasing the vacuum pressure within a sealed container. FIG. 3 shows that in one embodiment, the overall cross-sectional shape of the carrier 88 may be generally rectangular, having axially facing surfaces 102, 104 (top and bottom, respectively) and radially facing surfaces 106, 108 (inwardly and outwardly, respectively). The inwardly facing surface 106 may be coupled to the surface 94 of the seal ring 86, and in some regions of the carrier 88, the bottom surface 104 may include a trough or channel 96, reducing the quantity of material needed to form the carrier 88. The outwardly facing surface 108 generally coincides with the radially outer periphery 24 of the seal 20.

Figure 2:
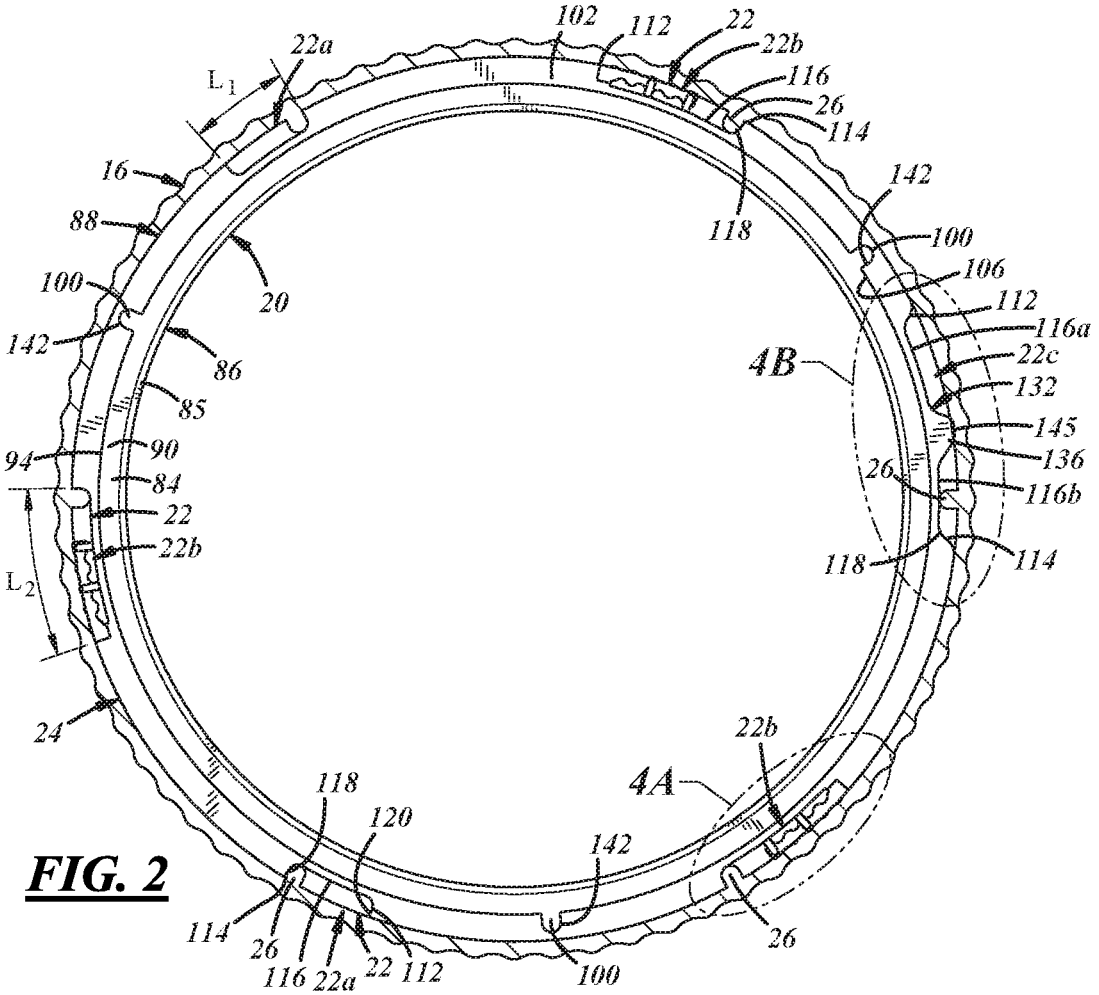
FIG. 2 is a fragmentary top view of the container package of FIG. 1, the seal being in a first position.

FIG. 2 illustrates one embodiment of the closure-driven features 22 circumferentially distributed along the outer periphery 24. While six closure-driven features are shown, not all of the features 22 need to be identical. It should be appreciated that more or less than this quantity may be possible in other embodiments. Each of the closure-driven features 22 has a first end 112 circumferentially spaced from a second end 114 that includes an abutment or stop surface 118 (e.g., in the top view of FIG. 2, the second end 114 being located in a clockwise direction with respect to the first end 112). A radially inwardly extending pocket or channel portion 116 is at least partially defined by the first and second ends 112, 114—facing radially outwardly. Among the six illustrated features 22, three different configurations in FIG. 2 are shown: two slotted-type closure-driven features 22*a*, three spring-type closure-driven features 22*b*, and one cam-following-type closure-driven feature 22*c*. As will be explained in greater detail below, other closure-driven features 22 and/or other arrangements of closure-driven features 22 are also possible (e.g., including arrangements which do not include one or more of features 22*a*, 22*b*, or 22*c*).

The slotted-type closure-driven features 22*a* may be identical, and therefore the additional aspects of only one feature 22*a* will be described. As shown in FIG. 2, the channel portion 116 of the slotted-type feature 22*a* extends from a secondary abutment or stop surface 120 at the first end 112 to the abutment surface 118 at the second end 114 having an arcuate length ($L_1$). While the slotted-type feature 22*a* is shown as an empty, arcuate channel, the slotted-type feature 22*a* may have different characteristics in other embodiments.

The spring-type closure-driven features 22*b* may be identical, and therefore the additional aspects of only one feature 22*b* will be described (see also FIGS. 2 and 4A). Again, the channel portion 116 is defined by the first and second ends 112, 114 having an arcuate length ($L_2$) which may be longer than the length ($L_1$). The spring-type feature 22*b* includes a spring or spring portion 122 having a longitudinally extending body 124 with a coupling end 126 coupled to and extending from the first end 112. The body 124 extends toward the second end 114 (e.g., clockwise) within the channel 116 terminating at a distal end 128 such that it measures less than length ($L_2$). According to at least one embodiment, the spring 122 comprises the first material (e.g., TPE) and overmolds a part of the carrier 88 near the first end 112 and passes through an opening 129 (shown in FIG. 4A) near the first end 112. Thus, in at least one embodiment, at least a portion of the first end 112 also is comprised of the first material.

The body 124 of the spring 122 may have any compressible arrangement including being coil-like (e.g., having a helical-shape), accordion-like, snake-like (e.g., having a sinusoidal-shape), etc. In the illustrated embodiment, the spring 122 has an uneven exterior surface 130 and various different cross-sectional areas along the length of its body 124. In one implementation, the cross-sectional areas are randomized (e.g., having random areas). In the embodiment shown in FIGS. 2 and 4A, two bridging portions 131 are shown coupling the spring body 124 to the carrier 88 within the channel 116, further enhancing the elasticity of the spring portion 122 when compressed, as will be described below. Other implementations of the spring-type closure-driven features 22*b* also exist; e.g., including implementations without the bridging portions 131.

As shown in FIGS. 2 and 4B, the cam-following-type closure-driven feature 22*c* includes a cam-follower 132 that includes a ramp or ramp portion 136 and a channel portion 116 on either side (i.e., channel portion 116*a* spans between the ramp 136 and the first end 112 and channel portion 116*b* spans between the ramp 136 and the second end 114). FIG. 4B illustrates a side 136*a* of ramp 136 (nearer end 114) having a more gradual slope than a side 136*b* (nearer end 112) to enable easier actuation when breaking a vacuum seal. The length of the channel portion 116 between the ramp 136 and the second end 114 may be less than length ($L_1$) (i.e., the length of the channel in the slotted-type closure-driven feature(s) 22*a*). As will be described more below, this may enable one of the cams 26 to drive the ramp 136 of feature 22*c* radially inwardly thereby releasing vacuum pressure within the container 12 before another cam 26 engages the abutment surface 118 of one of the slotted-type closure-driven features 22*a*.

The carrier 88, as shown in FIG. 2, may have other features as well. For example, the carrier 88 may have any suitable shape to accommodate the circumferentially spaced tabs 100 of the seal ring 86. As discussed above, these tabs 100 may provide additional bonding area between the seal ring 86 and the carrier 88. Three tabs 100 are illustrated; however, other quantities are possible.

The individual components of the closure assembly 14 shown in FIGS. 1 and 3 may be manufactured separately and thereafter assembled. The base 18 may be inserted into the skirt 16 via the bottom opening 80 without regard to orientation, and while the peripheral edge 52 of the base 18 may interfere with the base retaining bead 72, the skirt 16 may elastically deform, allowing the base 18 to be fitted or press-fit beyond the bead 72 so that the base 18 is located between the bead 72 and the flange 68 with the top side 48 facing the flange 68. In an upright position, the lip 56 of the base 18 may rest on the base retaining bead 72, inhibiting the base 18 from falling out of the skirt 16. The seal 20 may then be inserted into the skirt 16 via the bottom opening 80, and while the outwardly facing surface 108 may interfere with the seal retaining bead 74, the skirt 16 and/or the seal 20 may elastically deform, allowing the seal 20 to be fitted or press-fit beyond the bead 74 so that the seal 20 is located between the base and seal retaining beads 72, 74. During the fitting of the seal 20, the seal 20 and/or the skirt 16 may be rotated to align the cams 26 within the channels 116 of the closure-driven features 22 (e.g., nearer the respective second ends 114). Since all cams 26 may be identical, no particular cam 26 need be paired with a particular closure-driven feature 22—facilitating ease of assembly. Thus, in at least one embodiment, the base 18 is free to rotate independently of the skirt 16 while rotation of the seal 20 is limited by the freedom of the cams 26 within their respective channels 116.

When it becomes desirable to seal the container 12 (e.g., having heated product (P) therein), the retention elements 44 of the container 12 may be rotatably coupled to the skirt's 16 corresponding retention elements 76 (FIG. 3). While the skirt 16 is rotatably tightened, the cams 26 on the inner surface 28 of the skirt 16 may engage or press against the abutment surfaces 118 (FIG. 2) in each of the closure-driven features 22—the abutment surfaces 118 preventing over-rotation. It will be appreciated that since the cams 26 are captured within the channels 116, the seal 20 generally will rotate with the skirt 16. Mating of the retention elements 44, 76 draws the skirt 16 downward to a first position wherein the seal 20 is compressed between the sealing surfaces 40, 58 (of the container 12 and base 18, respectively). During packaging, vacuum further may compress the seal 20 as the base 18 is drawn down tighter (e.g., as the product P cools) thereby preventing rotation of the seal 20 with respect to the container 12. During the sealing process, the springs 122 and the cam-follower 132 of the seal 20 are not engaged, compressed, etc. (see FIGS. 2 and 4B).

Figure 6:
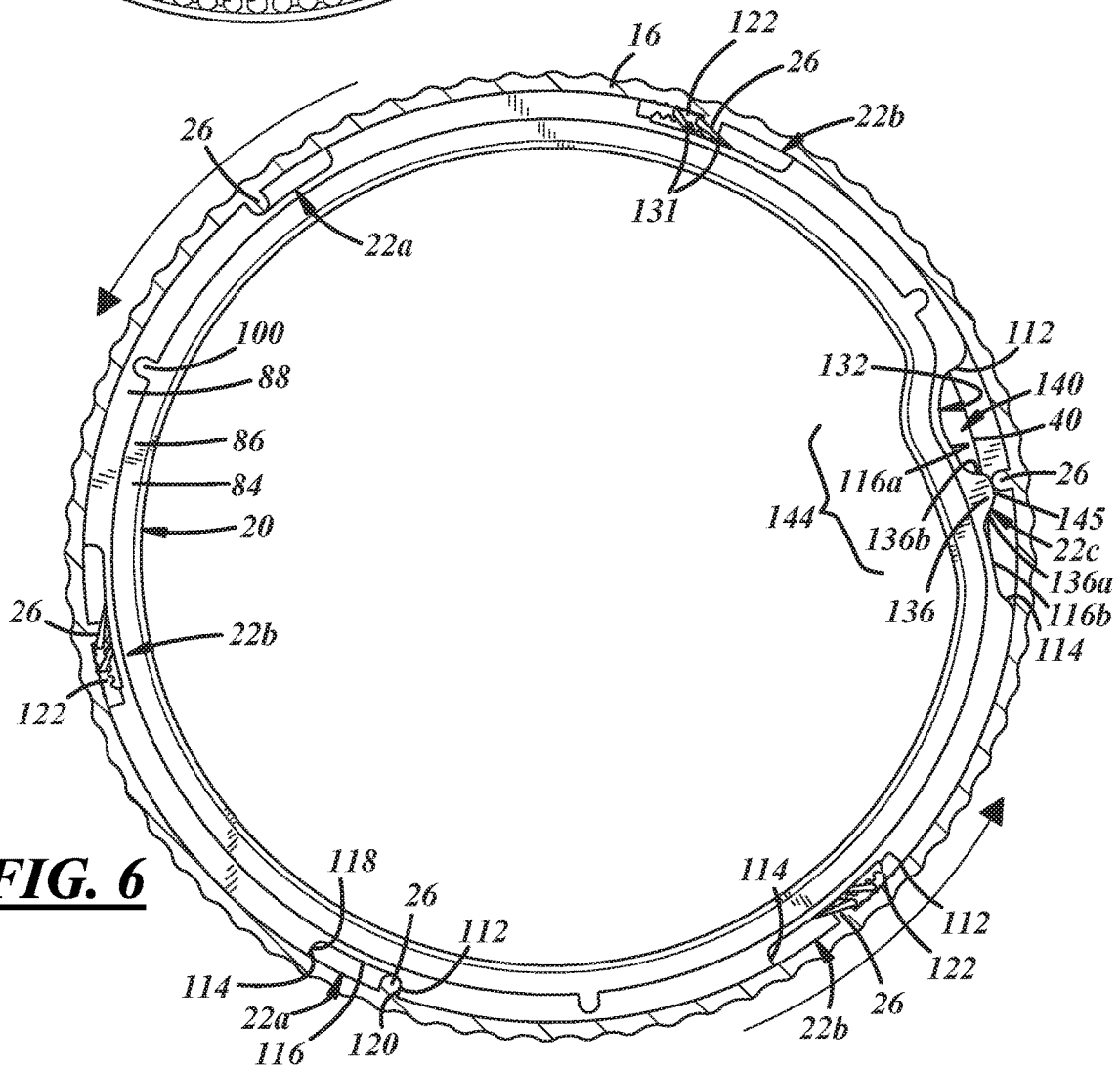
FIG. 6 is a fragmentary top view of the container package of FIG. 1, the seal being in a second position.

When it becomes desirable to open the vacuum sealed container 12, the skirt 16 is counter-rotated or loosened. During counter-rotation, as shown in FIG. 6, one or more of the cams 26 on the inner surface 28 of the skirt 16 compress the corresponding springs 122 on the seal 20 towards the first ends 112 while another cam 26 traverses the ramp 136 (via side 136*a*) of the cam-follower 132. As a result, a local or localized region 144 of the seal 20 displaces radially inwardly to a second position driven by the cam 26 forming a vacuum release path 140 (FIGS. 6-9). In the second position, the seal ring 86 is moved sufficiently away from between the sealing surfaces 40, 58 so that the vacuum path 140 enables fluid communication between the container's interior I and the air outside via channel 116 (e.g., 116*a*, 116*b*, or both)—releasing any pressure therein. Releasing vacuum pressure should be construed broadly to include ambient air moving in or out of the container 12; e.g., where the interior I of the container 12 was at a lower pressure, ambient air may rush into the interior I upon release of the vacuum pressure. As shown in FIG. 6, over compression of the springs 122 is prevented by closure-driven features 22*a*; more specifically, the two remaining cams engage the abutment surfaces 120 limiting the arcuate compression of the springs 122. Further, it will be appreciated that the length (L1) of features 22*a* may coincide with the length of a portion of closure-driven feature 22*c*—namely, the length between the second end 114 and a peak 145 of the ramp 136. Therefore, when the cams 26 have fully compressed the springs 122, the abutment surfaces 120 also inhibit the cam 26 at the ramp 136 from traversing onto side 136*b* and becoming stuck there (see FIG. 6).

Once the vacuum pressure is released, the springs 122 may decompress from the cams 26, forcing the seal 20 to rotate independently with respect to the skirt 16. For example, the springs 122 in the spring-type closure-driven features 22*b* may suitably rotate the seal 20 so that the cam 26 engaged with the ramp 136 is displaced back into its respective channel 116 (as shown in FIG. 2). In addition, the cam follower 132 may contribute to the rotation of the seal 20 (rotating the seal so that the cam 26—previously engaged with the ramp 136—is now displaced back into its respective channel 116*b*). And due to the elastic nature of the seal 20 (more specifically, the carrier 88), the deformed local region 144 may move from the second position back into the first position (FIG. 2). Therefore, the springs 122 will be more fit for re-use since they will not remain in a compressed, deformed, or otherwise distressed state. It will be appreciated that the springs 122 left in such a distressed state may permanently deform e.g., experiencing material creep. Thus, the closure assembly 14 is in the distressed state only momentarily, avoiding such permanent deformation.

Alternative embodiments of the present disclosure also exist. For example, the described seal 20 may have more or fewer closure-driven features 22; and correspondingly, the skirt 16 may have more or fewer cams 26. Similarly, the number of closure-driven features 22 having springs 122 and/or cam followers 132 may also vary.

Figure 10:
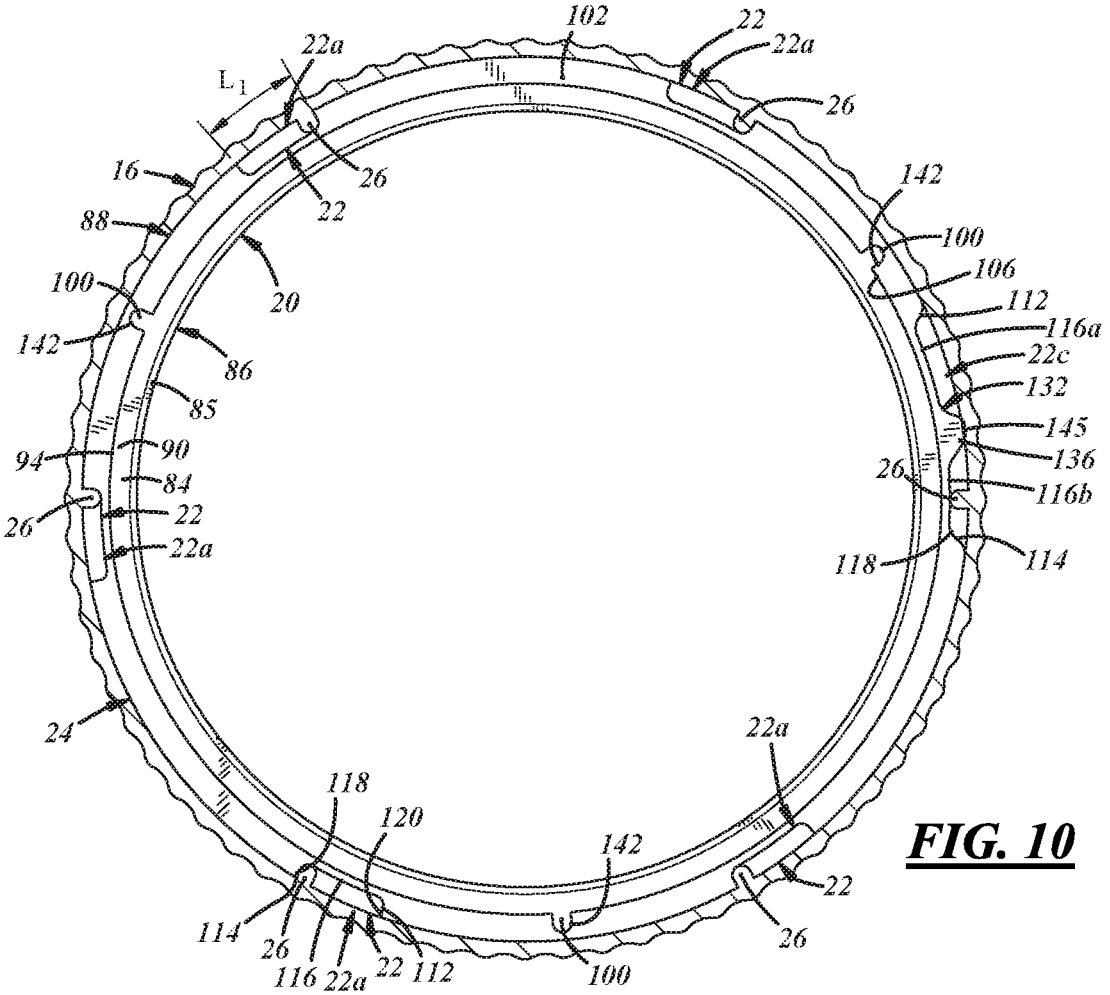
FIG. 10 is a top view of the container package illustrating a second embodiment of the seal, the seal being in a first position.

In at least one embodiment (shown in FIG. 10), no spring-type closure-driven features 22*b* are used. For example, the seal 20 comprises one or more slotted-type closure-driven features 22*a* and at least one cam-following closure-driven feature 22*c*. FIG. 10 illustrates an embodiment having five slotted-type closure-driven features 22*a* and one cam-following closure-driven feature 22*c*; however, this of course is merely an example. In this implementation, the seal 20 generally may operate as described above; however, instead of the springs 122 counter-rotating the seal 20 with respect to the skirt 16 (and the skirt cams 26), the channel portions 1116*a* and 116*b* of the cam follower 132 acts as a spring to resiliently return the seal 20 to its pre-stressed state (e.g., following a vacuum pressure release, as discussed above).

Figure 11:
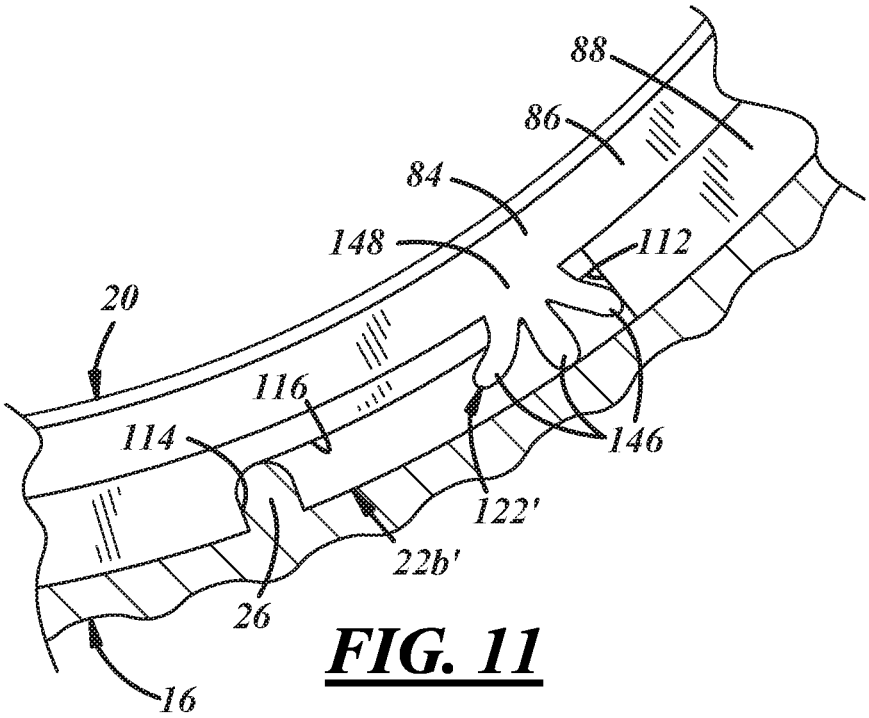
FIG. 11 is a fragmentary top view of the container package illustrating a third embodiment of the seal, the seal being in a first position.
Figure 12:
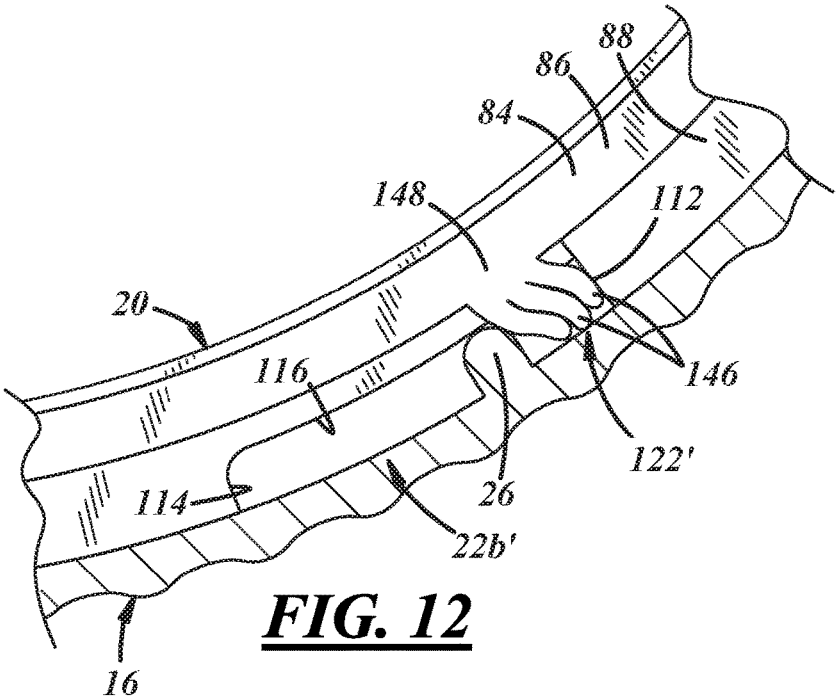
FIG. 12 is a fragmentary top view of the third embodiment shown in FIG. 11, the seal being in a second position.

FIGS. 11 and 12 illustrate another embodiment of a closure-driven feature; here, like numerals denote similar features and elements. Here, the spring-type closure-driven features 22*b*' include springs 122' having a radially outwardly extending body 148. The body 148 comprises a plurality of fingers 146 fanning outwardly from the channel portion 116 in different directions and biased to this position. For example, at least one finger 146 may extend partially circumferentially towards the first end 112 and at least one finger 146 may extend partially circumferentially towards the second end 114. Like the previously-described springs 122, springs 122' may be capable of collapsing inwardly under compressive force (FIG. 12) and resiliently flexing back to this fan-like position when the force is removed (FIG. 11 again). The illustrated embodiment has three fingers 146; however, other implementations are also possible.

Figure 13:
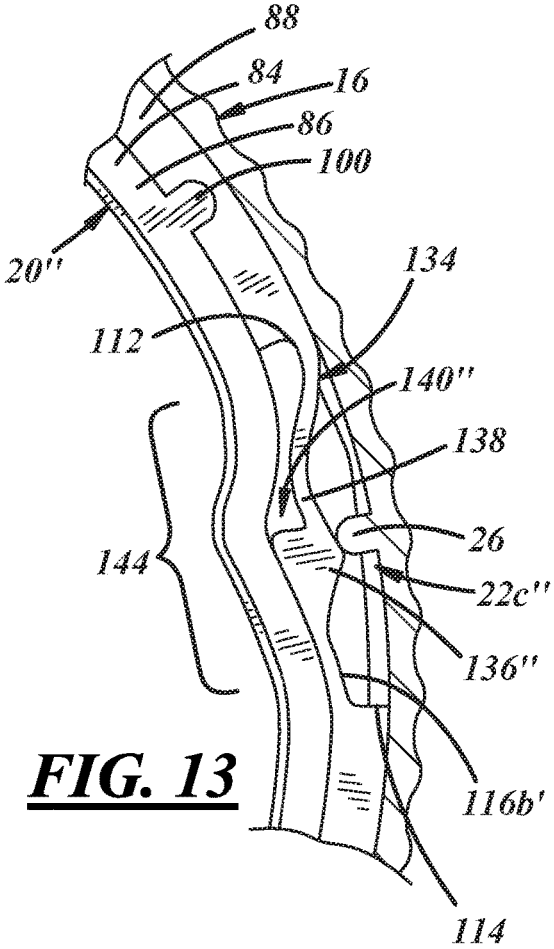
FIG. 13 is a fragmentary top view of the container package illustrating a fourth embodiment of the seal.

FIG. 13 illustrates another embodiment of the cam-follower-type closure-driven feature (22*c*")—shown in the second or driven position. Here, a flex portion or leaf spring 134 (shown deformed) extends circumferentially between the first end 112 and a ramp 136" defining a vacuum release path or passage 140" (e.g., flex portion 134 may be used instead of channel portion 116*a*). When the cam-follower-type closure-driven feature 22*c*" is not actuated (i.e., in the first position), the cam 26 is located in the channel 116*b*' (as discussed above with respect to feature 22*c*); however, as shown in FIG. 13, when the feature 22*c*" is actuated by the cam 26, the cam 26 moves up the ramp 136" and drives the feature 22*c*" radially inwardly enabling fluid communication between the interior (I) of the container 12 and the exterior thereof via the passage 140".

Figure 14:
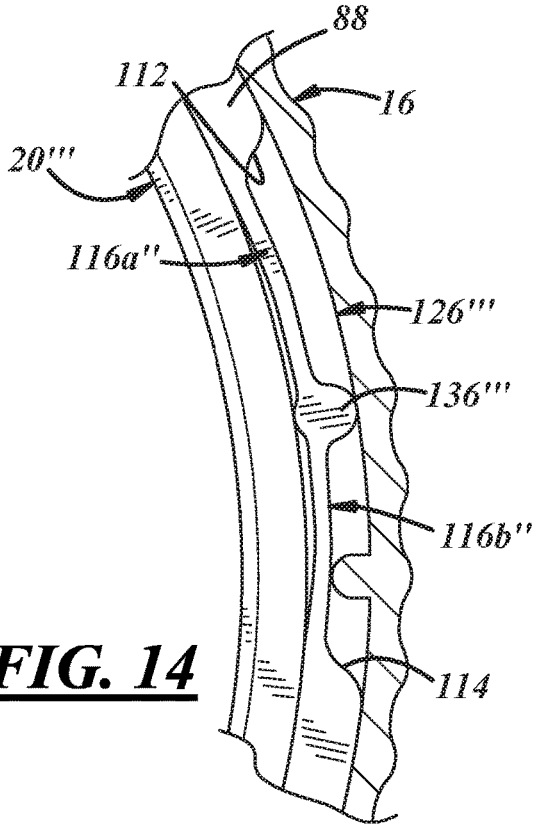
FIG. 14 is a fragmentary top view of the container package illustrating a fifth embodiment of the seal.

Another embodiment of the cam-follower is shown in FIG. 14. Here, a bulbous ramp 136'" is coupled to the first and second ends 112,144 by channel portions 116*a*", 116*b*", respectively. The spacing between the ramp 136'" and the second end 114 may approximate the length (L1) of the closure-driven features 22*a*. Therefore, in operation, this configuration may work similarly to the ramp shown in FIG. 2.

The container 12 and/or base 18 described herein each may be of one-piece integrally formed construction and may be manufactured according to one or more glass manufacturing processes. (The term "integrally formed construction" does not exclude one-piece integrally molded layered glass constructions of the type disclosed for example in U.S. Pat. No. 4,740,401, or one-piece glass bottles to which other structure is added after the bottle-forming operation.) In one embodiment, the container 12 may be fabricated in press-and-blow or blow-and-blow glass container manufacturing operations.

In production, and generally speaking, typical glass container manufacturing includes a "hot end" and a "cold end." The hot end may include one or more glass melting furnaces to produce a glass melt, one or more forming machines to form the glass melt into glass containers 12, and one or more applicators to apply a hot-end coating to the glass containers 12. The "hot end" also may include an annealing lehr, or at least a beginning portion of the annealing lehr, for annealing the glass containers therein. Through the lehr, the temperature may be brought down gradually to a downstream portion, cool end, or exit of the lehr. The "cold end" may include an end portion of the annealing lehr, applicators to apply one or more cold-end coatings to the glass containers downstream of the annealing lehr, inspection equipment to inspect the containers, and packaging machines to package the containers. Thus, a hot end coating is a coating applied at the hot end of the glass container manufacturing process, and a cold end coating is a coating applied at the cold end of the glass container manufacturing process.

In conjunction with the above description, the container 12 may be produced by the following glass container manufacturing process, which may or may not include all of the disclosed steps or be sequentially processed or processed in the particular sequence discussed, and the presently disclosed manufacturing process and marking methods encompass any sequencing, overlap, or parallel processing of such steps.

First, a batch of glass-forming materials may be melted. For example, a melting furnace may include a tank with melters to melt soda-lime-silica to produce molten glass. Thereafter, the molten glass may flow from the tank, through a throat, and to a refiner at the downstream end of the furnace where the molten glass may be conditioned. From the furnace, the molten glass may be directed toward a downstream forehearth that may include a cooling zone, a conditioning zone, and a downstream end in communication with a gob feeder. The feeder may measure out gobs of glass and deliver them to a glass container forming operation.

Next, the glass gobs may be formed into containers, for example, by forming machines, which may include press-and-blow or blow-and-blow individual section machines, or any other suitable forming equipment. Blank molds may receive the glass gobs from the feeder and form parisons or blanks, which may be at a temperature, for example, on the order of 900-1100° C. Blow molds may receive the blanks from the blank molds and form the blanks into glass containers 12, which may be at a temperature, for example, on the order of 700-900° C. Material handling equipment may remove the glass containers from the forming machines and place the containers 12 on conveyors or the like.

Also, the formed glass containers may be annealed, for example, by an annealing lehr. At an entry, hot end, or upstream portion of the annealing lehr, the temperature therein may be, for instance, on the order of 500-700° C. During this period of time, one or more of the coatings may or may not be applied to the neck 36 and at least a portion of an exterior surface of the container 12. Through the lehr, the temperature may be brought down gradually to a downstream portion, cool end, or exit of the lehr, to a temperature therein, for example, on the order of 65-130° C.

There thus has been disclosed a package that fully satisfies one or more of the objects and aims previously set forth. The disclosure has been presented in conjunction with an exemplary embodiment, and modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A package, comprising:

a container having a neck finish extending to an axial sealing surface that defines a container mouth, the neck finish having a plurality of retention features; and a closure assembly, comprising:

a skirt including a cylindrical wall having an upper portion that includes a radially, inwardly extending flange and a lower portion that includes a seal retaining bead and a plurality of cams extending radially inwardly from an inner surface of the wall;

a base; and a seal for a closure assembly, comprising:

a seal ring; and a carrier being coupled to the seal ring, extending circumferentially and radially outwardly of the seal ring to a radially outer periphery, and having a circumferentially extending pocket in the radially outer periphery adapted to release a vacuum pressure, wherein the seal further comprises a plurality of closure-driven features located radially inwardly of and spaced circumferentially along the radially outer periphery, at least one of the plurality of closure-driven features includes the pocket and the spring portion, wherein the base and the seal are captively carried between the flange and the seal retaining bead, wherein the circumferential location of the cams corresponds to the plurality of closure-driven features, wherein the cams protrude into the plurality of closure-driven features, wherein the seal further comprises a cam follower carried by one of the plurality of closure-driven features, wherein the seal ring of the seal is compressed between the base and the axial sealing surface of the container when the container retention features are engaged with a plurality of corresponding retention features on the closure assembly, and wherein, when the skirt is rotated with respect to the container, then at least one of the plurality of cams compresses the spring portion and another cam engages the cam-follower deforming a local region of the seal radially inwardly to release the vacuum pressure.

2. The package set forth in claim 1, wherein, after the vacuum pressure is released, the spring portion is configured to resiliently and substantially return to a pre-compressed state thereby rotating the seal independently of the skirt, wherein, in response to the rotation of the skirt, the local region of the seal elastically returns to a pre-deformation state.

3. The package set forth in claim 2, wherein at least one of the plurality of closure-driven features on the seal includes an abutment surface limiting the compression of the spring portion.

4. A package, comprising:

a container, including a base, a body extending away from the base, and a neck finish extending away from the body, the neck finish having a neck finish axial sealing surface, wherein at least a portion of the neck finish axial sealing surface extends both axially downwardly and radially outwardly, a mouth at the sealing surface opening to an interior of the container;

a lid extending entirely radially across the mouth and a longitudinal axis of the package and having a lid axial sealing surface located vertically above the neck finish axial sealing surface, wherein at least a portion of the lid axial sealing surface extends both axially upwardly and radially outwardly; and a skirt including a cylindrical wall having a lower portion configured to be coupled to the container and an upper portion that includes a radially inwardly extending flange configured to locate the lid against the container, wherein the neck finish and lid axial sealing surfaces are beveled, such that the neck finish axial sealing surface is a straight bevel surface that extends axially away from the base at a radially inwardly portion of the neck finish axial sealing surface more than at a radially outwardly portion of the neck finish axial sealing surface, and such that the lid axial sealing surface is a straight bevel surface extending axially away from a top side of the lid at a radially inwardly portion of the lid axial sealing surface more than at a radially outwardly portion of the lid axial sealing surface.

5. A package, comprising:

a container, including a base, a body extending away from the base, and a neck brush extending away from the body, the neck finish having a neck finish axial sealing surface, wherein at least a portion of the neck finish axial sealing surface extends both axially downwardly and radially outwardly;

a lid having a lid axial sealing surface corresponding to the neck finish axial sealing surface, wherein at least a portion of the lid axial sealing surface extends both axially upwardly and radially outwardly, wherein the neck finish and lid axial sealing surfaces are beveled, such that the neck finish axial sealing surface is a straight bevel surface that extends axially away from the base at a radially inwardly portion of the neck finish axial sealing surface more than at a radially outwardly portion of the neck finish axial sealing surface, and such that the lid axial scaling surface is a straight bevel surface extending axially away from a top side of the lid at a radially inwardly portion of the lid axial sealing surface more than at a radially outwardly portion of the lid axial sealing surface; and a seal including a seal ring configured to be received between the container and the lid and including a body having an upper side configured to engage the lid axial sealing surface and a lower side configured to engage the neck finish axial sealing surface, wherein the seal also includes a carrier coupled to the seal ring, and extending circumferentially and radially outwardly of the seal ring to a radially outer periphery.

6. The package of claim 5, wherein the seal ring is composed of a relatively flexible material and the carrier is composed of a relatively rigid thermoplastic polymer material.

7. The package of claim 6, wherein the carrier is overmolded to the seal ring.

8. A package comprising:

a container, including a base, a body extending away from the base, and a neck finish extending away from the body, the neck finish having a neck finish axial sealing surface, wherein at least a portion of the neck finish axial sealing surface extends both axially downwardly and radially outwardly;

a lid having a lid axial sealing surface corresponding to the neck finish axial sealing surface, wherein at least a portion of the lid axial sealing surface extends both axially upwardly and radially outwardly, wherein the neck finish and lid axial sealing surfaces are beveled, such that the neck finish axial sealing surface is a straight bevel surface that extends axially away from the base at a radially inwardly portion of the neck finish axial sealing surface more than at a radially outwardly portion of the neck finish axial sealing surface, and such that the lid axial scaling surface is a straight bevel surface extending axially away from a top side of the lid at a radially inwardly portion of the lid axial sealing surface more than at a radially outwardly portion of lid axial sealing surface; and a seal including a seal ring configured to be received between the container and the lid and including a body having an upper side configured to engage the lid axial sealing surface and a lower side configured to engage the neck finish axial sealing surface, wherein the seal ring is T-shaped having a head extending radially inwardly from the body and having an axial extent greater than that of the body and adapted to hug inner regions of the container and the lid proximate to the axial sealing surfaces when the lid is coupled to the container with the seal ring therebetween.

9. A package, comprising:

a container, including a base, a body extending away from the base, and a neck finish extending away from the body, the neck finish having a neck finish axial sealing surface, wherein at least a portion of the neck finish axial sealing surface extends both axially downwardly and radially outwardly; and a closure assembly configured to be coupled to the container, and including a lid having a lid axial sealing surface located vertically above the neck finish axial sealing surface, wherein at least a portion of the lid axial sealing surface extends both axially upwardly and radially outwardly, such that the lid axial sealing surface is a straight bevel surface extending axially away from a top side of the lid at a radially inwardly portion of the axial sealing surface more that at a radially outwardly portion of the lid axial sealing surface, a skirt including a cylindrical wall having a lower portion configured to be coupled to the container, and an upper portion that includes a radially inwardly extending flange configured to locate the ltd against the container, and a seal including a seal ring configured to be received between the container and the lid and including a body having an upper side configured to engage the lid axial sealing surface and a lower side configured to engage the neck finish axial sealing surface.

10. The package of claim 9, wherein the skirt lower portion includes a seal retaining bead extending radially inwardly from an inner surface of the skirt lower portion and configured to capture and retain the seal.

11. The package of claim 9, wherein the skirt lower portion includes a container retention element extending radially inwardly from an inner surface of the skirt lower portion and configured to couple the skirt to the container, and wherein the skirt lower portion includes a lid retaining bead extending radially inwardly from an inner surface of the shirt lower portion and configured to capture and retain the lid.

12. The package of claim 9, wherein the container and the lid are composed of glass, and the skirt is composed of metal or plastic.

13. The package of claim 9, wherein the seal is T-shaped with a head extending radially inwardly from the body, and having an axial extent greater than that of the body, and being configured to hug inner regions of the container and the lid proximate to the axial sealing surfaces when the lid is coupled to the container with the seal ring therebetween.

14. The package of claim 13, wherein the lid has an inner region that extends away from the lid axial sealing surface at an oblique angle radially inwardly and axially outwardly.

15. The package of claim 4, further comprising:

a seal including a seal ring configured to be received between the container and the lid and including a body having an upper side configured to engage the lid axial sealing surface and a lower side configured to engage the neck finish axial sealing surface.

16. The package of claim 4, wherein the seal is T-shaped with a head extending radially inwardly from the body, and having an axial extent greater than that of the body, and being configured to hug inner regions of the container and the lid proximate to the axial sealing surfaces when the lid is coupled to the container with the seal ring therebetween.

17. The package of claim 16, wherein the lid has an inner region that extends away from the lid axial sealing surface at an oblique angle radially inwardly and axially outwardly.

18. The package of claim 4, wherein the skirt lower portion includes a container retention element extending radially inwardly from an inner surface of the skirt lower portion and configured to couple the skirt to the container, and wherein the skirt lower portion includes a lid retaining bead extending radially inwardly from an inner surface of the skirt lower portion and configured to capture and retain the lid.

19. The package of claim 4, wherein the container and the lid are composed of glass, and the skirt is composed of metal or plastic.

* * * * *